US008273466B1

(12) United States Patent
Saraiya et al.

(10) Patent No.: US 8,273,466 B1
(45) Date of Patent: Sep. 25, 2012

(54) NON-CADMIUM COMPOSITE COATING

(75) Inventors: Naishadh K. Saraiya, San Jose, CA (US); Mahesh Naik, Fremont, CA (US)

(73) Assignee: CSL, Inc., Santa Clara, CA (US)

( * ) Notice: Subject to any disclaimer, the term of this patent is extended or adjusted under 35 U.S.C. 154(b) by 830 days.

(21) Appl. No.: 11/588,725

(22) Filed: Oct. 26, 2006

Related U.S. Application Data

(60) Provisional application No. 60/732,248, filed on Oct. 27, 2005.

(51) Int. Cl.
*B32B 15/04* (2006.01)
*B32B 15/20* (2006.01)

(52) U.S. Cl. ..... 428/680; 428/621; 428/652

(58) Field of Classification Search ..... None
See application file for complete search history.

(56) References Cited

U.S. PATENT DOCUMENTS

| | | | | |
|---|---|---|---|---|
| 3,355,267 | A * | 11/1967 | Du Rose | 428/639 |
| 4,720,403 | A * | 1/1988 | Jasenof et al. | 427/327 |
| 6,103,404 | A * | 8/2000 | Ross et al. | 428/680 |
| 2003/0121412 | A1 * | 7/2003 | Sugiura et al. | 92/70 |

OTHER PUBLICATIONS

Websters Online Visual Dictionary; http://visual.merriam-webster.com/science/scientific-symbols/mathematics/mathematics_1.php—Printed Aug. 18, 2010.*
Scientific Symbols; http://www.electrobionics.org/symbols.html (2004).*

* cited by examiner

*Primary Examiner* — Jennifer McNeil
*Assistant Examiner* — Adam Krupicka
(74) *Attorney, Agent, or Firm* — Nixon Peabody LLP

(57) ABSTRACT

A non-cadmium multi-layered composite coating is disclosed. Such coating achieves desirable lubricity, retains electrical conductivity, meets high performance industry standards for corrosion resistance, and avoids certain environmental and health hazards. Further disclosed are methods of applying such coating on various substrates using a combination of electrolytic and electro-less plating techniques. Such coating may be advantageously applied in machining and electrical interconnects, and are particularly useful in the defense and consumer electronics and appliances industries.

19 Claims, No Drawings

NON-CADMIUM COMPOSITE COATING

This application claims the benefit of Provisional Application 60/732,248, filed Oct. 27, 2005, which is incorporated herein by reference in its entirety.

TECHNICAL FIELD

The present disclosure relates in general to protective coatings. Specifically, the present disclosure relates to composite coatings with multiple layers, and methods for applying such coatings on aluminum alloy and other substrates. More specifically, the layers of such composite coatings are each specifically designed and together provide desirable lubricity, corrosion resistance, and other benefits without using cadmium materials. A combination of electrolytic and electroless plating techniques are utilized to apply such coatings onto a variety of substrates.

BACKGROUND OF THE INVENTION

In the machining area and particularly for electronic interconnects, protective coatings are widely used to provide protection to substrates in corrosive environments. The demand on high-performance protective coatings continue to grow, as advances are being made in cutting-edge areas such as outer-space and deep-sea exploitation, defense weaponry, and nanotechnology concerning nano machines. Good-quality coatings are also in need in the consumer appliances and electronics industries, so are efficient and reliable processes for applying such coatings.

Many types of coating materials and a range of coating techniques have been used and reported in the material, electronics, chemical engineering, and other related industries. See, generally, B. Popov (2004) *Electro Deposition of Alloys & Composites with Superior Corrosion and Electrical Properties*, Plating and Surface Finishing; J. Dini, 1992, *Electrodeposition: The Material Science of Coatings and Substrates*, p. 316, Noyce Publication; E W. Brooman (2000) *Corrosion Behavior of Environmentally Acceptable Alternatives to Cadmium & Chromium Coating*, Metal Finishing, pages 42-50. Common coating techniques include among other things electro plating, electro-less plating, vacuum deposition, sputtering, evaporation, and thermal spray or High Velocity Oxygen Fuel (HVOF). Of these techniques, electro plating and electro-less plating require relatively low investment, are relatively easy to operate, and thus are favored by many users.

The standards for high-performance coatings include many aspects, chief among which is corrosion resistance. The American Society for Testing and Materials (ASTM) International is the industry organization responsible for establishing and maintaining such standards. Founded in 1898 and formerly known as ASTM, ASTM International provides a global forum for the development and publication of standards for materials, products, systems, and services ("ASTM Standards"). The adoption of ASTM Standards is generally voluntary and by consensus; however, many ASTM Standards have become widely accepted as the industry standards. In more than 130 industry areas, ASTM Standards serve as a basis for research, manufacturing, testing and quality control, commercial transaction, and regulatory activities.

Specifically with respect to corrosion, ASTM Committee G01 on Corrosion of Metals, a committee formed in 1964, has jurisdiction over more than 70 standards, published in the Annual Book of ASTM Standards. These standards have played, and continue to play, an important role in all industries concerned with the problem of corrosion. Examples of such corrosion problem include corrosion of nuclear materials, atmospheric corrosion, corrosion in computers and other electronic devices, corrosion in natural waters, corrosion in soils, and corrosion of reinforcing steel. Laboratory corrosion tests and other similarly controlled tests have been designed and used to measure corrosion, and evaluate corrosion resistance qualitatively and/or quantitatively.

One principal corrosion test is the salt spray test pursuant to ASTM-B 117, and another principle corrosion test is the sulfur dioxide gas spray test pursuant to ASTM-G 85. Both standards will be discussed in more detail below. As quality and performance requirements become more and more demanding especially for materials in highly specialized fields such as outer space and deep sea operations, the need for protective coatings to meet high standards becomes increasingly pressing. Few, if any, commercially available coating today is capable of withstanding at least 1000 hours of salt spray pursuant to ASTM-B 117, and none is capable of withstanding at least 336 hours of sulfide dioxide gas spray pursuant to ASTM-G 85.

For example, cadmium, or cadmium over nickel (a.k.a. Olive Drab or Cd/Ni), has been universally accepted as a coating of choice where strong corrosion resistance to neutral salt spray and a certain level of inherent lubricity are required. Many alternative metals and metal alloys (including zinc alloys and tin alloys) have been evaluated, and none has yet performed as well as Cd/Ni. However, in the aggressive pH 2.5 condition of sulfur dioxide gas, even Cd/Ni coating fails miserably.

In addition to corrosion resistance and lubricity, the desirability of a protective coating is also dictated by its potential environmental and/or health impact. For example, cadmium has been identified as a carcinogen, and efforts have been underway to find a replacement for cadmium or the Cd/Ni coating described above. See, id., E W. Brooman, Mental Finishing. Another fold of reason for replacing Cd/Ni coating is that it contains hexavalent chromium—a substance that lends Cd/Ni its distinctive olive color and enhances its resistance to salt spray. Hexavalent chromium is deemed carcinogenic by the U.S. Environmental Protection Agency (EPA), and restricted in Europe pursuant to a European Union Directive that has taken effect on Jul. 1, 2006. See, Restriction of Hazardous Substances in Electrical and Electronics Equipment (RoHS) Directive (2002/95/EC). Promulgated in Europe, this RoHS Directive has worldwide implications. It restricts, or aims to eliminate, the use of cadmium, chromium, and other chemicals that are deemed environmental and/or health hazards.

Therefore, there is a need for protective coatings to replace cadmium where corrosion resistance and natural lubricity of cadmium are required, and where the coatings remain electrically conductive. There is also a related need for protective coatings capable of withstanding prolonged exposure to both acidic sulfur dioxide gas spray and neutral salt spray. There is a further need for methods, processes, or techniques of applying such protective coatings to substrates of varied nature and properties.

SUMMARY OF THE INVENTION

The present invention is directed to a multi-layered composite coating for a substrate, comprising: a first layer of a first phosphorus-nickel alloy, said first layer comprising 2-13% phosphorus (w/w) and being 0.3-1.2 mil in thickness and a second layer of nickel having a stress level below 7,000 psi tensile (+ve) or compressive (−ve) (both types of stress sometimes referred to as ±7,000), wherein said second layer is applied on top of said first layer, and said first layer is applied on the surface of said substrate.

The present invention is also directed to a multi-layered composite coating for a substrate, comprising: a first layer of a first phosphorous-nickel alloy on the surface of said substrate; a second layer of nickel having a stress level below 7,000 psi tensile (+ve) or compressive (−ve) on top of said first layer; and, a third layer of a second phosphorus-nickel alloy on top of said second layer, wherein said coating is capable of resisting at least 1000 hours of salt spray.

The present invention is further directed to a multi-layered composite coating for a substrate, comprising: a first layer of a first phosphorus-nickel allow on the surface of said substrate; a second layer of nickel having a stress level below 7,000 psi tensile (+ve) or compressive (−ve) on top of said first layer; a third layer of a second phosphorus-nickel alloy on top of said second layer; a fourth layer of a nickel-tungsten-boron alloy or a nickel-boron alloy on top of said third layer; a fifth layer of a nickel/polytetrafluoroethylene composite on top of said fourth layer; and, a sixth layer of dispersible tungsten disulfide on top of said fifth layer, wherein no electric-magnetic-field cell is generated between each of said layers, wherein the level of lubricity of said coating is substantially the same as that of cadmium, wherein said coating is capable of resisting at least 1000 hours of salt spray.

DETAILED DESCRIPTION OF THE INVENTION

Definitions

Throughout the present disclosure relevant terms, including among other things plating, electro plating, and electroless plating, alloy, aluminum alloy, and the 6061-T6 alloy, are to be understood consistently with their typical meanings established in the relevant art, i.e. the art of material sciences, chemistry, chemical engineering, environmental chemistry, electronics, physics, material engineering, nanotechnology, and other related areas. However, further clarifications and descriptions are provided for certain terms as set forth below:

ASTM-B 117, as used herein, refers to an industry standard for measuring corrosion resistance that is set forth by ASTM International, Committee G01 on Corrosion of Metals. Specifically, ASTM-B117 sets forth the procedures and apparatus for operating salt spray (fog) testing. See, e.g., the Annual Book of ASTM Standards, Designation: B 117-73. The longer a coating is capable of enduring such salt spray (measured by number of hours), the stronger its ability to resist corrosion by neutral salts. Over the years the standard has been made more stringent as the requirements of various industries become more demanding. In one embodiment, a protective coating disclosed herein is capable of endure at least 1000 or more hours of salt spray pursuant to ASTM-B 117.

ASTM-G 85, as used herein, refers to anther ASTM standard for measuring corrosion resistance. See, e.g., the Annual Book of ASTM Standards, Designation: G 85-98. Specifically, ASTM-G 85 sets forth the procedures and apparatus for operating sulfur dioxide gas spray testing. The sulfur dioxide gas is introduced into the test chamber at a pH value of about 2.5. The longer a coating is capable of enduring such sulfur dioxide gas spray, the stronger its ability to resist highly acidic corrosion. In another embodiment, a protective coating disclosed herein is capable of endure at least 336 hours of sulfur dioxide gas spray pursuant to ASTM-G 85.

With respect to corrosion testing and in discussing the above ASTM Standards, the terms resisting, enduring, passing, and withstanding are used interchangeably throughout this application.

The terms "coatings" and "protective coatings" are used interchangeably throughout this application. The terms "electrolytic plating" and "electro plating" are used interchangeably in this application. The terms "electrolytic" and "electrolytically plated" are used interchangeably in this application.

Composite coatings, as used herein, refer to protective coatings having included therein more than one chemical coating material. Composite coatings may have one or more layers in various embodiments.

Interconnects, as used herein, refer to any connecting parts or mechanisms of a machine, an electronic device or equipment, or other appliances. Interconnects may be made of conducting or non-conducting materials, or combinations thereof. Electronic Interconnects, as used herein, refer to interconnects used in electronics.

A "low stressed" metal, as used herein, refers to a metal stressed either tensile (+ve) or compressive (−ve) in nature, and in the range below 7,000 psi tensile (+ve) or compressive (−ve). Preferably, the stress is tensile (+ve) in nature and is below 5,000 Psi.

It is an object of this disclosure to provide protective coatings with desirable lubricity, electrical conductivity, and corrosion resistance. It is a further object of this disclosure to provide methods for applying such protective coating onto a variety of substrates.

In accordance with this disclosure, there is provided, in one embodiment, a multi-layered composite coating for a substrate. The multi-layered coating includes: a first layer of a phosphorus-nickel alloy, which has 2-13% (preferably 7.5-13%, more preferably 9.5-12.5%, 11.5-13%) phosphorus and is 0.3-1.2 mil in thickness, preferably at least 0.5 mil in thickness; and a second layer of low stress nickel, preferably 0.2-0.8 mil in thickness. This second layer is applied on top of the first layer, which is applied on the surface of the substrate.

In another embodiment, the multi-layered coating further includes a third layer of a phosphorus-nickel alloy applied on top of the second layer. This third layer has 2-13% (preferably 7.5-13%, more preferably 11.5-13%) phosphorus, and is preferably 0.3-1.2 mil in thickness. In yet another embodiment, the coating further includes a fourth layer of a nickel alloy on top of the third layer. The nickel alloy may be a nickel-tungsten-boron alloy and preferably 0.05-0.25 mil in thickness. Alternatively, the nickel alloy is a nickel-boron alloy comprising at least 5% boron, and 0.5-1.0 mil in thickness. In still another embodiment, the coating further comprises a fifth layer of a lubricating material such as a nickel composite applied on top of the fourth layer. The nickel composite is nickel/TEFLON® (polytetrafluoroethylene)/phosphorus composite in one embodiment, which preferably include 4-6% TEFLON®, 9.5-12.5% phosphorus, and 81.5-86.5% nickel, and is 0.2-0.5 mil in thickness.

In a further embodiment, the coating further comprises a sixth layer of a sealing material, organic or inorganic, applied on top of the fifth layer. The sealing material is dispersible tungsten disulfide in one embodiment, and is 0.02-0.06 mil in thickness. In another alternative embodiment, the sealing material is selected from the group consisting of (i) a non-chromium seal, (ii) a trivalent chromate seal, and (iii) an organic hydrophobic material, wherein the sealing material is thin enough to retain the electrical conductivity of the coating. In a further alternative embodiment, the coating has five layers where the fifth layer of nickel composite is omitted and the sixth layer is directly applied onto the fourth layer.

The present invention also provides another embodiment of a multi-layered composite coating for a substrate. This coating includes: a first layer of high phosphorus electro-less nickel (phosphorus-nickel alloy) on the surface of the substrate; a second layer of low stress electrolytic nickel on top of the first layer; and, a third layer of high phosphorus electro-less nickel on top of the second layer. This coating is capable of resisting at least 1000 hours of salt spray pursuant to ASTM-B 117, a standard set forth by ASTM International, or another suitable standard similar to ASTM-B 117.

In another embodiment, the coating is further capable of resisting at least 336 hours of sulfur dioxide gas spray pursuant to ASTM-G 85. In yet another embodiment, this coating further includes a fourth layer of nickel alloy on top of the third layer. The fourth layer is a nickel-tungsten-boron alloy or a nickel-boron alloy.

In still another embodiment, the coating further includes a fifth layer of a lubricating material preferably nickel composite applied on top of the fourth layer. The nickel composite is nickel/TEFLON® composite in one embodiment. In a further embodiment, the coating further includes a sixth layer of a sealing material applied on top of the fifth layer. The sealing material may be organic and inorganic, and in one embodiment is dispersible tungsten disulfide. In an alternative embodiment, the sealing material is selected from the group consisting of (i) a non-chromium seal, (ii) a trivalent chromate seal, and (iii) an organic hydrophobic material, wherein the sealing material is thin enough to retain the electrical conductivity of the coating. In a further alternative embodiment, the multi-layered coating has five layers where the fifth layer of the nickel composite is omitted and the sixth layer is directly applied onto the fourth layer.

The present invention further provides another embodiment of a multi-layered composite coating for a substrate. The coating includes a first layer of a phosphorus-nickel alloy on the surface of the substrate, a second layer of low stress nickel on top of the first layer, a third layer of high phosphorus electro-less nickel on top of the second layer; a fourth layer of a nickel-tungsten-boron alloy or a nickel-boron alloy on top of the third layer; a fifth layer of nickel/TEFLON® composite on top of the fourth layer; and, a sixth layer of dispersible tungsten disulfide on top of the fifth layer, wherein no electric-magnetic-field cell is generated between each of the layers, wherein the level of lubricity of the coating is substantially the same as cadmium, wherein the coating is capable of resisting at least 1000 hours of salt spray pursuant to the ASTM-B 117, or another suitable standard similar to ASTM-B 117.

In another embodiment, the coating is further capable of resisting at least 336 hours of sulfur dioxide gas spray pursuant to ASTM-G 85, or another suitable standard similar to ASTM-G 85. In yet another embodiment, the first layer of the coating is 0.3-1.2 mil in thickness, the second layer is 0.2-0.8 mil in thickness, the third layer is 0.3-1.2 mil in thickness, the fourth layer is 0.05-0.25 mil in thickness, the fifth layer is 0.2-0.5 mil in thickness, and the sixth layer is 0.02-0.06 mil in thickness. In a further embodiment, the first layer is 0.5 mil in thickness, the second layer is 0.4 mil in thickness, the third layer is 0.5 mil in thickness, the fourth layer is 0.1 mil in thickness, the fifth layer is 0.3 mil in thickness, and the sixth layer is 0.02 mil in thickness.

In certain embodiments, one or more of the layers in the aforementioned coating are amorphous. In other embodiments, the coating is continuous, pore free, and crack free; no electric-magnetic-field cell is generated between each of the layers; and the lubricity of the coating is substantially the same as cadmium.

The substrate is selected from the group consisting of an aluminum alloy, a non-aluminum conductor, and a non-conductor. The aluminum alloy may be aluminum, the 6061-T6 alloy having a specific composition and stress level of aluminum, or other suitable alloy. The non-aluminum conductor includes a stainless steel surface. The non-conductor is selected from the group consisting of polyetheretherketone polymer, polyetherimide resin, and polyphenylene sulfide resin.

The aforementioned coatings in the various embodiments may be advantageously applied in machining and electrical interconnects, and useful in diverse industries including defense, electronics, and appliances.

The present invention provides a method for depositing a multi-layered composite coating onto a substrate. The method includes: (a) depositing onto the substrate in a carbonate-based deposition bath a first layer of a phosphorus-nickel alloy; and (b) depositing in a nickel sulfamate bath a second layer of low stress nickel onto the first layer. The first layer has 2-13% phosphorus (preferably 7.5-13%, more preferably 11.5-13%) and is 0.3-1.2 mil in thickness, and the second layer is 0.2-0.8 mil in thickness.

In yet another embodiment, the method includes treating the substrate by ultrasonic etching prior to depositing onto the substrate the first layer. The ultrasonic etching may be performed in an alkaline solution at 25 KHz, 10 Watts/gal, and for 5-40 min. In still another embodiment, the method includes ultrasonic neutralizing the substrate in a citric acid bath after the ultrasonic etching. The ultrasonic neutralizing may be performed at 40 KHz, 20 Watts/gal and for 1-5 min. In a further embodiment, the method includes treating the substrate with an acidic solution. The acidic solution is selected from the group consisting of citric acid, phosphate acid, sulfuric acid, nitric acid, or combinations thereof. In still a further embodiment, the method includes treating the substrate with bromide-based deoxidizer. In another embodiment, the method further includes zincating the substrate prior to depositing onto the substrate the first layer. The zincating includes immersing the substrate in a solution of zincate thereby depositing a film of zinc on the surface of the substrate.

According to another embodiment, the method includes depositing onto the second layer in a carbonate-based deposition bath a third layer of a phosphorus-nickel alloy. This third layer has 2-13% phosphorus and is preferably 0.3-1.2 mil in thickness. According to still another embodiment, the method includes activating the third layer by dipping the third layer in ammonium hydroxide thereby improving adhesion. According to a further embodiment, the method includes depositing onto the third layer a fourth layer of an alloy. This fourth layer is a nickel-tungsten-boron alloy, e.g., 63-65% nickel, 35-37% tungsten, and 1-2% boron, and is 0.05-0.25 mil in thickness. According to an alternative embodiment, a fourth layer of a nickel-boron alloy is deposited, which has 95% nickel and 5% boron, and is 0.5-1.0 mil in thickness.

According to still a further embodiment, the method includes depositing onto the fourth layer a fifty layer of a nickel/TEFLON®/phosphorus composite, which has 4-6% TEFLON®, 9.5-12.5% phosphorus, and 81.5-86.5% nickel, and is 0.2-0.5 mil in thickness. According to another embodiment, the method includes depositing onto the fifth layer a sixth layer of dispersible tungsten disulfide. This six layer is 0.02-0.06 mil in thickness. In an alternative embodiment, the sixth layer is selected from the group consisting of (i) a non-chromium seal, (ii) a trivalent chromate seal, and (iii) an organic hydrophobic material thin enough to retain the electrical conductivity of the coating. In a further alternative embodiment, the method omits the application of the fifth layer of nickel/TEFLON®/phosphorus composite, and applies the sixth layer directly onto the fourth layer.

The composite coating has multiple layers. In various embodiments, two or more of the following six layers may be included: a first layer of a phosphorus-nickel alloy; a second layer of low stress nickel, preferably electrolytically plated; a third layer of high phosphorus electroless nickel; a fourth layer of a nickel alloy, electrolytically plated; a fifth layer of lubricating materials, preferably a nickel composite coating; and a sixth layer of a sealing material. These layers may be applied sequentially—from the first layer to the sixth layer—onto the surface of a substrate. Each layer is specifically designed, and contributes to the overall performance of the composite coating. Those skilled in the plating industry and the related areas would appreciate that more or less layers may be applied based on the customer specification and the performance requirements in a given project.

For example, by selecting the appropriate combinations of the layers and determining specific thickness of each individual layers, one can achieve the desired level of lubricity, corrosion resistance, electrical conductance, and wear resistance. Such selection may be made based on one or more of the following factors: (i) the electromotive force of each layer; (ii) whether an individual layer is sacrificial or barrier by nature; (iii) the lubricating, anti-galling properties of the material used in each layer; (iv) whether a layer is hydrophobic and hence capable of resisting salt water corrosion; and (v) whether the top layer, i.e., the layer last applied, is impervious to sulfur dioxide gas and hence capable of resisting acidic corrosion of sulfur dioxide fog.

In various embodiments, the multi-layered composite coating is characterized by numerous performance and environmental/health benefits it provides. These benefits include one or more of the following: (i) no cadmium; (ii) no hexavalent chromium; (iii) compliance with the relevant RoHS and EPA regulations; (iv) passing 336 hours of sulfur dioxide fog test pursuant to ASTM-G 85; (v) passing 1000 hours of neutral salt spray test pursuant to ASTM-B 117; (vi) not susceptible to hydrogen embrittlement (unlike cadmium or Cd/Ni); and (vii) providing both barrier layer and sacrificial layer protection (unlike cadmium or Cd/Ni, which essentially is a sacrificial coating).

Of the aforementioned six layers, the first, second and third layers form a building block for the rest of the layers. In one embodiment, the first layer is high phosphorus electro-less nickel, which contains preferably 7.5-13%, more preferably 11.5-13% (w/w) phosphorus. This first layer may be 0.3-1.2 mil thick. The second layer is low stress nickel, and may be 0.2-0.8 mil thick.

In certain embodiments, three of the six layers—the first, second, and third layers—together provide a continuous, pore free, micro crack free coating. This three-layer coating achieves the same level of corrosion resistance as cadmium or Cd/Ni coating. The third-layer is high phosphorus electroless nickel, containing preferably 7.5-13%, more preferably 11.5-13% (w/w) phosphorus. This layer may be 0.3-1.2 mil thick.

A fourth layer of nickel alloy may be added to the three-layer coating in another embodiment. This fourth layer may be a nickel-tungsten-boron alloy or a nickel-boron alloy. The nickel-tungsten-boron alloy contains 63-65% nickel, 35-37% tungsten, and 1-2% boron. It may be 0.05-0.25 mil thick. The nickel alloy contains at least 5% boron. It may be 0.5-1.0 ml/thick.

A fifth layer of a lubricating material may be applied on top of the fourth layer in yet another embodiment. The lubricating material is preferably nickel composite. The nickel composite may be nickel/TEFLON®/phosphorus composite in one embodiment. The nickel/TEFLON®/phosphorus composite contains 4-6% TEFLON®, 9.5-12.5% phosphorus, and 81.5-86.5% nickel. This layer may be 0.2-0.5 mil thick.

A sixth layer of a sealing material, organic or inorganic, may be applied on top of the fifth layer in a further embodiment. The sixth sealing layer must be extremely thin in certain embodiments, so as to retain the electrical conductivity of the coating. The sealing material is dispersible tungsten disulfide in one embodiment, and is 0.02-0.06 mil thick. In an alternate embodiment, the sealing material may be (i) a non-chromium seal such as potassium permanganate, (ii) a trivalent chromium in combination with Fluoro Zirconate compound (Hex free), or (iii) an organic hydrophobic material, wherein the sealing material is thin enough to retain the electrical conductivity of the coating.

In certain embodiments, the composite coating omits the fifth layer of nickel composite and has the sixth layer of a sealing material directly applied onto the fourth layer of nickel alloy.

In summary, various combinations of layers in the composite coating may be strategically designed to optimize corrosion resistance, lubricity, electrical conductance, and wear resistance necessary for a given environment. Each layer serves a specific purpose. Multiple factors may be considered in making the selection of the layers and the combinations thereof. For example, in one embodiment, no electric-magnetic-field (EMF) cell is generated between each layer. In another embodiment, one or more layers of the coating are amorphous. In yet another embodiment, one or more layers of the coating are compatible with the corrosion reactants such as sulfides. In still another embodiment, diffusion pathways for oxygen or other corrosive gases such as sulfur dioxide are minimized. In a further embodiment, one or more barrier layers are used. In still a further embodiment, one or more sacrificial layers are used. In another embodiment, one or more layers use chemically reduced nickel in an acidic medium. In a further embodiment, the electrical conductivity of the composite coating is preferably close to that of copper, and such electrical conductivity is retained even after exposure to a corrosive environment.

Methods for Applying the Multi-Layered Composite Coating

In a preferred embodiment, a substrate is pretreated before depositing the composite coating thereon. An ultrasonic etching treatment is preformed, which brings out the best grain structure of the substrate such as aluminum and thereby allow for high degree of adhesion. Ultrasound is applied at 25 KHz, 10 Watts/gal, and for 5-40 min. In one embodiment, both alkali and acids are used to remove surface contamination, followed by treatment of chloride or sulfate based acids. In another embodiment, only acidic solutions are used, such as citric acid, so as to maintain the surface smoothness. The treatment in the citric acid bath is a neutralizing step after the initial ultrasonic etching, preformed with the 40 KHz, 20 Watts/gal ultrasound, and for 1-5 min. Other acidic solutions may be also used, including phosphoric acid, sulfuric acid, nitric acid, or combinations thereof.

The substrate may be further treated with bromide-based deoxidizer, which contributes to the better maintenance of the grain structure. The better grain structure in turn facilitates the subsequent zincating step in another embodiment. The zincating step involves immersing the substrate in a solution of zincate thereby depositing a film of zinc on the surface of the substrate.

Once the substrate has been pretreated, it is ready to go through the plating process for depositing two or more of the six layers of the composite coating. The method of applying the composite coating according to various embodiments takes advantage of two basis plating systems: the electro plating and electro-less plating systems. An electro-less plating system includes a deposit container capable of being heating and maintaining certain level of heat. The substrate is immersed into the deposit bath. No electrical current is required in this system. An electro plating system includes an anode and a cathode in the deposit container. Electrical current flows between the anode and cathode in the deposit bath, which drives the depositing of the coating materials on the substrate.

Layers of the composite coating are deposited sequentially onto a substrate. In one embodiment, the first layer of high phosphorus electroless nickel is deposited onto the pretreated substrate in a carbonate-based deposition bath, using an electroless plating system. This layer is deposited up to 0.3-1.2 mil thick.

A second layer of low stress nickel is then deposited onto the first layer in a nickel sulfamate bath, using an electro plating system. This layer is deposited up to 0.2-0.8 mil thick.

A third layer of high phosphorus electro-less nickel is then deposited onto the second layer in a carbonate-based deposition bath, using an electro-less plating system. This layer is deposited up to 0.3-1.2 mil in thick. In certain embodiments, a further activation step is performed, including dipping the third layer in ammonium hydroxide thereby improving adhesion.

A fourth layer of a nickel-tungsten-boron alloy or a nickel-boron alloy is then deposited onto the third layer, using an electro plating system. This layer is deposited up to 0.05-0.25 mil in thickness for the nickel-tungsten-boron alloy, or 0.5-1.0 mil in thickness for the nickel-boron alloy.

Further, a fifth layer of a lubricating material is then deposited onto the fourth layer. The lubricating material is preferably nickel composite, and Ni/TEFLON® composite in one embodiment. This layer is deposited up to 0.2-0.5 mil thick.

In certain embodiments, a sixth layer of a sealing material is then deposited onto the fifth layer. The sixth sealing layer is dispersible tungsten disulfide in one embodiment. This layer is deposited up to 0.02-0.06 mil in thickness. Alternatively, after the first five layers the coating may be sealed with (i) a non-chromium seal, (ii) a trivalent chromate seal, or (iii) an organic hydrophobic material thin enough to retain the electrical conductivity of the coating.

As described above, one or more of the six layers may be omitted in certain embodiments in the application of these composite coatings. For example, the fifth layer of nickel/TEFLON® composite may be omitted, and the sixth layer may be deposited directly onto the fourth layer.

Various Substrates for the Multi-Layered Composite Coating

The preferred substrates are aluminum alloys, and particularly the 6061-T6 alloy, given its widespread usage in the machining area and electrical interconnect market. In alternative embodiments, other substrates may be used with the multi-layered composite coating. These other substrates include non-conductors and non-aluminum conductors, as selected below in Examples 1-3 for application of composite coatings.

In one embodiment the non-aluminum conductor substrate may be a stainless steel surface. In another embodiment the non-conductor is polyetheretherketone polymer, such as VICTREX® PEEK™ polymer, a high performance thermoplastic with high temperature resistance, wear resistance, chemical resistance, hydrolysis resistance, inherent purity, and good electrical properties. In yet another embodiment, the non-conductor substrate may be polyetherimide resin, such as ULTEM® Polyetherimide resin (PEI), an amorphous high performance polymer with good thermal properties, chemical resistance, dimensional stability, and inherent flame retardancy. In yet another embodiment, the non-conductor substrate is polyphenylene sulfide resin, a polymeric fiber used in structural composites to provide heat and chemical resistance.

The various embodiments are further described by the following examples, which are illustrative of the disclosed embodiments but do not limit the same in any manner.

EXAMPLES

Example 1

A Composite Coating Applied on Aluminum Substrate

For an aluminum substrate, such as a 6061-T6 alloy, a composite coating with the following layers is prepared:

First layer: high phosphorus electro-less nickel; 0.3 to 1.0 mil thick; and 9.5 to 12.5% phosphorus.

Second layer: low stress nickel, preferably electrolytic; and 0.2 to 0.8 mil thick.

Third layer: high phosphorus electro-less nickel; 0.3 to 1.0 mil thick; and 9.5 to 12.5% phosphorus.

Fourth layer: nickel alloy, preferably electrolytic; one of Ni—W, Ni—W-B; Ni—Co, and Ni—Co—W; and 0.05 to 0.25 mil thick.

Fifth layer: lubricating materials; Ni/TEFLON® composite, and sixth layer of $WS_2$ (tungsten disulfide), or organic film; and 0.01 to 0.4 mil thick.

Example 2

A Composite Coating Applied on a Stainless Steel Substrate

For a non-aluminum conducting surface, such as stainless steel or cold rolled steel, following an initial treatment of nickel strike to improve adhesion, a composite coating with the following layers is prepared:

First layer: high phosphorus electro-less nickel; 0.3 to 1.0 mil thick; and 9.5 to 12.5% phosphorus.

Second layer: low stress nickel, preferably electrolytic; and 0.2 to 0.8 mil thick.

Third layer: high phosphorus electro-less nickel; 0.3 to 1.0 mil thick; and 9.5 to 12.5% phosphorus.

Fourth layer: nickel alloy, preferably electrolytic; one of Ni—W, Ni—W-B; Ni—Co, and Ni—Co—W; and 0.05 to 0.25 mil thick.

Fifth layer: lubricating materials; Ni/TEFLON® composite, and sixth layer of $WS_2$ (tungsten disulfide), or organic film; and 0.01 to 0.4 mil thick.

Example 3

A Composite Coating Applied on a Non-Conductor Surface

For a non-conductor surface, such as polyetheretherketone polymer, polyetherimide resin, and polyphenylene sulfide resin, a metallization pretreatment is performed according to the common practice of sensitizing and activation using Sn/Pd solutions. See, G J Rudzki (1983) *Surface Finishing Systems*, p. 72-73, Published by Am. Soc. For Metals. After sensitizing and activation, the non-conductor substrate is built up with electrolytic copper to a thickness suitable for the plating of the following layers.

First layer: high phosphorus electro-less nickel; 0.3 to 1.0 mil thick; and 9.5 to 12.5% phosphorus.

Second layer: low stress nickel, preferably electrolytic; and 0.2 to 0.8 mil thick.

Third layer: lubricating materials; Ni/TEFLON® composite, and fourth layer of $WS_2$ (tungsten disulfide), or organic film; and 0.01 to 0.4 mil thick.

It is to be understood that the description, specific examples and data, while indicating exemplary embodiments, are given by way of illustration and are not intended to limit the various embodiments of the present disclosure. All references cited herein for any reason, are specifically and entirely incorporated by reference. Various changes and modifications within the present disclosure will become apparent to the skilled artisan from the description and data contained herein, and thus are considered part of the various embodiments of this disclosure.

We claim:

1. A multi-layered composite coating for a substrate, comprising:

a first layer of a first phosphorus electro-less nickel alloy on top of the surface of said substrate, said first layer comprising 9.5-13% phosphorus (w/w) and being 0.3-1.2 mil in thickness;

a second layer of electrolytic nickel metal having a stress level below 7,000 psi compressive (−ve) or tensile (+ve) stress, wherein said second layer is on top of said first layer, and being 0.2-0.8 mil in thickness;

a third layer of phosphorus electro-less nickel alloy on top of said second layer and having 9.5-13% phosphorus (w/w) and being 0.3-1.2 mil in thickness;

a fourth layer comprised of one of: Ni—W-B, and Ni—Co—W, on top of said third layer and being 0.05-0.25 mil in thickness;

a fifth layer comprised of a nickel/polytetrafluoroethylene composite on top of said fourth layer and being 0.2-0.5 mil in thickness; and a sixth layer of a sealing material on top of said fifth layer.

2. The coating of claim 1, wherein said fourth layer comprises at least 5% boron.

3. The coating of claim 1, wherein the fifth layer comprises polytetrafluoroethylene, phosphorus, and nickel, and being 0.2-0.5 mil in thickness.

4. The coating of claim 1, wherein said sixth layer is selected from (i) an inorganic dispersible tungsten disulfide, or (ii) an organic hydrophobic sealing material, on top of the fifth layer.

5. The coating of claim 1, wherein said sixth layer of sealing material is thin enough to retain the electrical conductivity of the coating.

6. The coating of claim 1, wherein at least one of the six layers in said coating is amorphous.

7. The coating of claim 1, wherein said substrate is selected from the group consisting of an aluminum alloy, a non-aluminum conductor, and a non-conductor.

8. The coating of claim 7, wherein said aluminum alloy is 6061-T6 alloy, wherein said non-aluminum conductor comprises a stainless steel surface, and wherein said non-conductor is selected from the group consisting of polyetheretherketone polymer, polyetherimide resin, and polyphenylene sulfide resin.

9. The coating of claim 1 wherein said coating is capable of resisting at least 1000 hours of salt spray.

10. The coating of claim 9, wherein said coating is further capable of resisting at least 336 hours of sulfur dioxide gas spray.

11. The coating of claim 1, wherein no electric-magnetic-field cell is generated between each of the six layers in said coating.

12. The coating of claim 1, wherein said sealing material is organic and being 0.01-0.4 mil in thickness.

13. The coating of claim 1, wherein said sealing material is dispersible tungsten disulfide, being 0.02-0.06 mil in thickness.

14. The coating of claim 1, wherein the sixth layer of sealing material is selected from the group consisting of (i) non chromium seal, (ii) a trivalent chromate seal and (iii) an inorganic sulfide or an organic hydrophobic material.

15. A multi-layered composite coating for a substrate, comprising: a first layer of a first phosphorus-nickel alloy on the surface of said substrate, a second layer of electrolytic nickel metal having a stress level below 7,000 psi tensile (+ve) or compressive (−ve), on top of said first layer, a third layer of a second phosphorus-nickel alloy on top of said second layer, a fourth layer of a nickel-tungsten-boron alloy or a nickel-boron alloy on top of said third layer, a fifth layer of a nickel/polytetrafluoroethylene composite on top of said fourth layer, and a sixth layer of material on top of said fifth layer, wherein no electric-magnetic-field cell is generated between each of said layers.

16. The coating of claim 15, wherein the sixth layer is comprised of dispersible tungsten disulfide.

17. The coating of claim 15, wherein said first layer is 0.3-1.2 mil in thickness, said second layer is 0.2-0.8 mil in thickness, said third layer is 0.3-1.2 mil in thickness, and said fourth layer is 0.05-0.25 mil in thickness, said fifth layer is 0.2-0.5 mil in thickness, and said sixth layer is 0.02-0.06 mil in thickness.

18. The coating of claim 15, wherein said substrate is selected from the group consisting of an aluminum alloy, a non-aluminum conductor, and a non-conductor.

19. The coating of claim 18, wherein said aluminum alloy is the 6061-T6 alloy, wherein said non-aluminum conductor comprises a stainless steel surface, and wherein said non-conductor is selected from the group consisting of polyetheletherketone polymer, polyetherimide resin, and polyphenylene sulfide resin.

* * * * *